United States Patent [19]

Berchowitz

[11] 4,387,566

[45] Jun. 14, 1983

[54] INDEPENDENTLY VARIABLE PHASE AND STROKE CONTROL FOR A DOUBLE ACTING STIRLING ENGINE

[75] Inventor: David M. Berchowitz, Scotia, N.Y.

[73] Assignee: Mechanical Technology Incorporated, Latham, N.Y.

[21] Appl. No.: 242,452

[22] Filed: Mar. 11, 1981

[51] Int. Cl.[3] ..... F02G 1/06

[52] U.S. Cl. ..... 60/518; 60/525; 74/571 M; 74/836

[58] Field of Search ..... 60/517, 518, 525; 92/13, 13.1; 74/571 M, 835, 836

[56] References Cited

U.S. PATENT DOCUMENTS

| | | | |
|---|---|---|---|
| 2,465,139 | 3/1949 | Van Weenen et al. | 60/518 |
| 3,457,722 | 7/1969 | Bush | 62/6 X |
| 3,538,706 | 11/1970 | Toepel | 60/525 |
| 3,742,719 | 7/1973 | Lagodmos | 60/518 X |
| 4,228,656 | 10/1980 | MacGlashan | 60/518 |
| 4,230,026 | 10/1980 | Hartley | 92/138 |
| 4,236,874 | 12/1980 | Sisk | 74/571 M |

OTHER PUBLICATIONS

"Self Starting, Intrinsically Controlled Stirling Engine", N. E. Polster and W. R. Martini, 1976 IECEC, pp. 1511–1518, Sep. 12, 1976.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A phase and stroke control apparatus for the pistons of a Stirling engine includes a ring on the end of each piston rod in which a pair of eccentrics is arranged in series, torque transmitting relationship. The outer eccentric is rotatably mounted in the ring and is rotated by the orbiting ring; the inner eccentric is mounted on an output shaft. The two eccentrics are mounted for rotation together within the ring during normal operation. A device is provided for rotating one eccentric with respect to another to change the effective eccentricity of the pair of eccentrics. A separately controlled phase adjustment is provided to null the phase change introduced by the change in the orientation of the outer eccentric, and also to enable the phase of the pistons to be changed independently of the stroke change.

30 Claims, 11 Drawing Figures

30'
82'
84'
127
127'
74
146
144
73'
132
134
128
128'
66'
32'
158
142
142
162
162
164
160
166
168
140
130
(133L, 133S)
127
127'
82'
84'

INDEPENDENTLY VARIABLE PHASE AND STROKE CONTROL FOR A DOUBLE ACTING STIRLING ENGINE

BACKGROUND OF THE INVENTION

The Government of the United States of America has rights in this invention pursuant to Contract No. DEN 3-32 awarded by the U.S. Department of Energy.

This invention relates to a motion conversion and power control apparatus for a heat engine, and more particularly to an independently adjustable phase and stroke control apparatus incorporated in the reciprocating-to-rotating motion conversion mechanism of a Stirling engine.

A Stirling engine is a clean and quiet heat actuated power source that is capable of using virtually any fuel that will produce heat. Moreover, the low speed torque characteristics of the Stirling engine make it ideal for certain applications requiring high torque at low speed such as automotive applications. Finally, the closed Stirling cycle is inherently clean and therefore the interior of the engine should remain in pristine condition for its entire life. For these and other reasons, the Stirling engine has, in the last decade or so, attracted a new interest and is the subject of considerable development activity to produce a commercially viable Stirling engine which can compete successfully against the existing heat engines now available such as the Otto, diesel, and gas turbine engines.

The potential of the Stirling engine has gone largely unrealized because of practical difficulties that a high temperature combustor and high pressure working fluid introduce, and because the conventional power control techniques for conventional heat engines do not provide the response time needed for adequate power control of the Stirling engine. In particular, the high temperature external combustor and heat system of a Stirling engine has considerable thermal inertia which does not permit effective power control by fuel or air control to the combustor. It also requires a certain warm-up time to raise the heater to operating temperature, and then a period of "after-run" to cool the hot heater to prevent overheating the engine by conduction from the hot end. In addition, the high pressure of the gas in the engine requires a mechanically robust heater head and engine block which tends to result in a low specific power for the engine. Finally, the power control techniques which have been introduced to provide an acceptable engine power output response time have the disadvantage of extreme complexity and cost and very little if any engine braking. As a consequence of these problems, the efforts to produce a commercially viable automotive Stirling engine in the past have been unsuccessfully even though they have been attempted by resourceful and innovative organizations.

One promising approach to the problem is suggested in my copending application Ser. No. 242,453 for "Double Acting Stirling Engine Phase Control" filed concurrently herewith and incorporated herein by reference. This technique incorporates a phase control in the motion conversion device. It contributes to the solution of all of the aforementioned problems with Stirling engine design and does so in such a simple and inexpensive manner that it appears to be a likely candidate for implementation in a commercial kinematic Stirling engine. For this reason, I have concluded that certain refinements would be desirable. In particular, I believe that control flexibility would be improved with the capability to control both piston stroke and phase, and to do so independently of each other.

SUMMARY OF THE INVENTION

Accordingly, it is an object of this invention to provide a combined phase and stroke control apparatus for Stirling engines. It is another object of this invention to provide a phase and stroke control mechanism incorporated in the motion conversion apparatus for a Stirling engine. It is a further object of this invention to provide a power control system for a Stirling engine employing an independently adjustable phase and stroke control apparatus incorporated in the reciprocating-to-rotating motion conversion device of a kinematic Stirling engine.

The objects of the invention are attained in the preferred embodiment by a series connection of two eccentrics linked between the output power shaft and the piston rod, and an apparatus for varying the angular position of the two eccentrics with respect to each other so that their eccentricities are selectively added or subtracted to control the stroke of the pistons. The phase between adjacent pistons is changed by rotating one eccentric with respect to the output shaft, or by rotating the eccentrics on thermodynamically connected pistons is opposite direction, and/or by changing the phase angle between two crankshafts to which the pistons are connected.

DESCRIPTION OF THE DRAWINGS

The invention and its many attendent objects and advantages will become more clear upon reading the following description of the preferred embodiments in conjunction with the following drawings, wherein.

DESCRIPTION OF THE PREFERRED EMBODIMENTS

Figure 1:
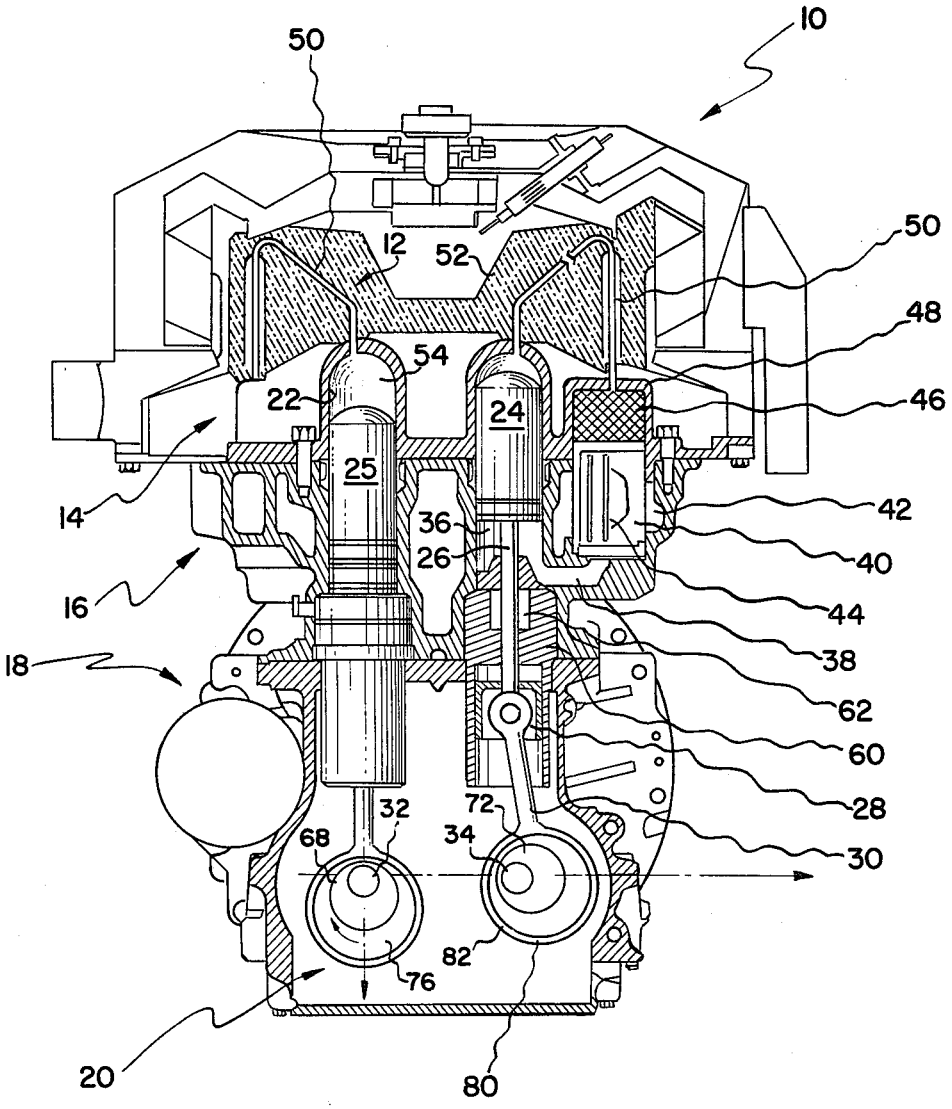
FIG. 1 is an elevation, partially in section, of a Stirling engine incorporating a power control and motion conversion device made in accordance with this invention.

Referring now to the drawings wherein like and primed reference numerals designate identical and corresponding parts, respectively, and more particularly to FIG. 1 thereof, a four cylinder, double acting Siemens Stirling engine is shown having a combustor 10 mounted on a heater 12 which is connected to a heater head 14 of the Stirling engine. The heater head is mounted on the top of an engine water jacket 16 to which is connected a crankcase 18 containing a motion conversion and piston stroke and phase control apparatus 20 made according to this invention. The heater head 14 includes a plurality (e.g. 4) of cylinders 22, each of which contains an axially reciprocating piston 24 connected by a piston rod 26 to a crosshead 28. The crosshead drives a connecting rod 30 which is connected to the motion conversion and piston stroke and phase control apparatus 20. The engine is shown with four pistons, but could have any even number of pistons greater than three, connected to two parallel driveshafts 32 and 34 which are linked to a power output shaft 35, shown only in FIG. 2.

The operation of the engine is as follows: cool working gas in the compression space 36 of the cylinder 22 below the piston 24 is compressed by downward movement of the piston 24 and flows through a duct 38 into a cooler 40 in the water jacket 16 where it is cooled by a coolant such as water circulating through the cooling passages 42 and around the tubes 44 of the cooler through which the gas flows. The cold gas then enters a regenerator 46 which is a matrix of fine wires having high heat capacity and high temperature resistant characteristics contained within a regenerator housing 48 formed on the heater head 14. The gas flowing through the regenerator 46 absorbs the heat which was deposited in the regenerator during the previous pass of the gas in the other direction, and then flows out of the regenerator into a finned heat exchanger or a set of thin tubes 50 which are brazed to the top of the regenerator housing 48 and are held at a high temperature by a latent heat thermal energy storage medium 52 surrounding the tubes 50. The thermal energy storage medium 52 can be a salt such as lithium fluoride which melts at a high temperature and is held at its high temperature by a set of heat pipes heated by the combustor 10 whose operation is automatically controlled by temperature sensors in the heat storage medium 52. A suitable thermal energy storage system is shown in ASME Paper 80-C2/Sol-13 by Zimmerman et al. The other ends of the finned heater tubes 50 are connected to the top of the cylinder 22 in which reciprocates a piston 25 connected to the other shaft 32. The working gas expands into the expansion space 54 of the cylinder 22 above the piston and drives the piston 25 downward to produce output power in the shaft 32.

A seal housing 60 is mounted in a cavity in the water jacket 16 coaxial with the cylinders 22. The seal housing 60 contains a seal assembly shown schematically at 62 and exemplified in U.S. Pat. No. 3,848,877 for "Seal for Piston Rod of Stirling Engine" issued to Bengtson, et al on Nov. 19, 1974. This seal prevents leakage of high pressure working gas in the compression space 36 past the piston rod 26 into the crankcase 18. However, to produce an effective seal, it is necessary to squeeze a sealing ring against the piston rod with high pressure to produce a high pressure sliding seal interface. This seal exerts a substantial frictional force on the piston rod which represents a direct power loss to the engine.

Another major power loss occurs as a result of hysteresis and viscous flow losses in the working gas as it is compressed and expanded, and as it flows back and fourth through the heat exchangers 40, 46 and 50 between the expansion space 54 and the compression space 36. These losses are functions of the magnitude of the pressure swing in the working space, and the volume of gas which is circulated between the expansion and compression spaces of the engine.

Piston rod friction losses, hysteresis losses, and viscous flow losses are all functions of piston stroke. A short stroke results in a smaller working gas pressure swing and a lower volume of gas circulated through the gas flow system, and results in a shorter and slower piston rod stroke. In addition, the frictional losses of the piston moving in the cylinder 22 and the crosshead 28 moving in the crosshead guide are correspondingly reduced at shorter piston stroke.

Figure 2:
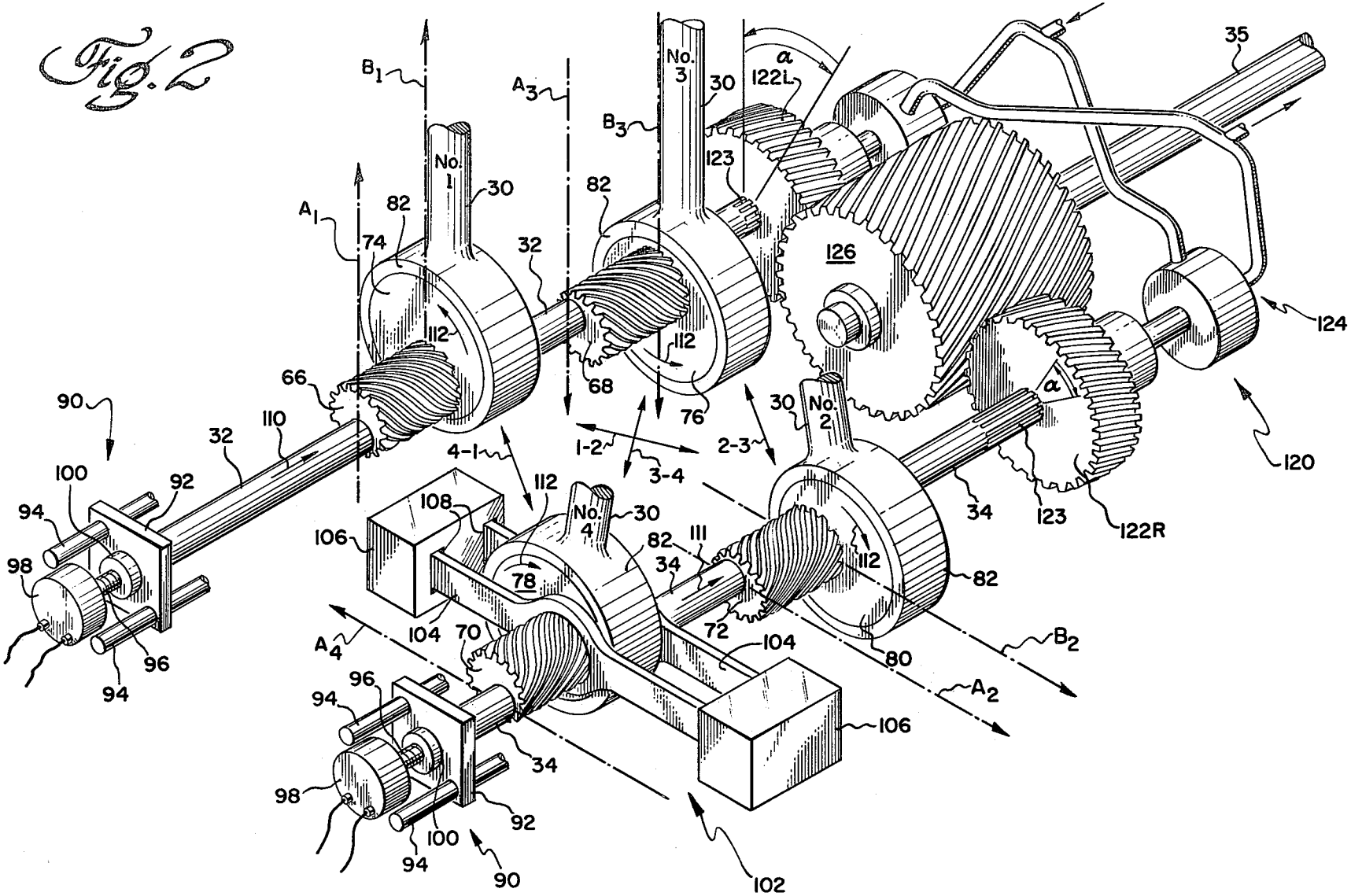
FIG. 2 is a perspective view of the power control and motion conversion device in the engine shown in FIG. 1.

One form of piston stroke control apparatus is shown in FIG. 2. For control of pistons No. 1 and No. 3, two cylindrical bodies 66 and 68 are mounted eccentrically on one driveshaft 32 with their axes of maximum eccentricity $A_1$ and $A_3$ oriented 180° apart on the shaft. A second pair of eccentric bodies 70 and 72 are similarly mounted on the driveshaft 34 with their axes of maximum eccentricity $A_4$ and $A_2$, respectively, oriented 180° apart on the shaft 34 and normally oriented at 90° to the axes of maximum eccentricity $A_1$ and $A_3$ of the bodies 66 and 68 on the shaft 32. The external cylindrical surface of each of the eccentric bodies 66, 68, 70 and 72 is helically threaded or splined as shown in FIG. 2. The threads or splines on the bodies 66 and 68 extend clockwise from the left-hand ends, and the threads or splines on the bodies 70 and 72 extend counterclockwise from the left-hand ends.

Figure 3:
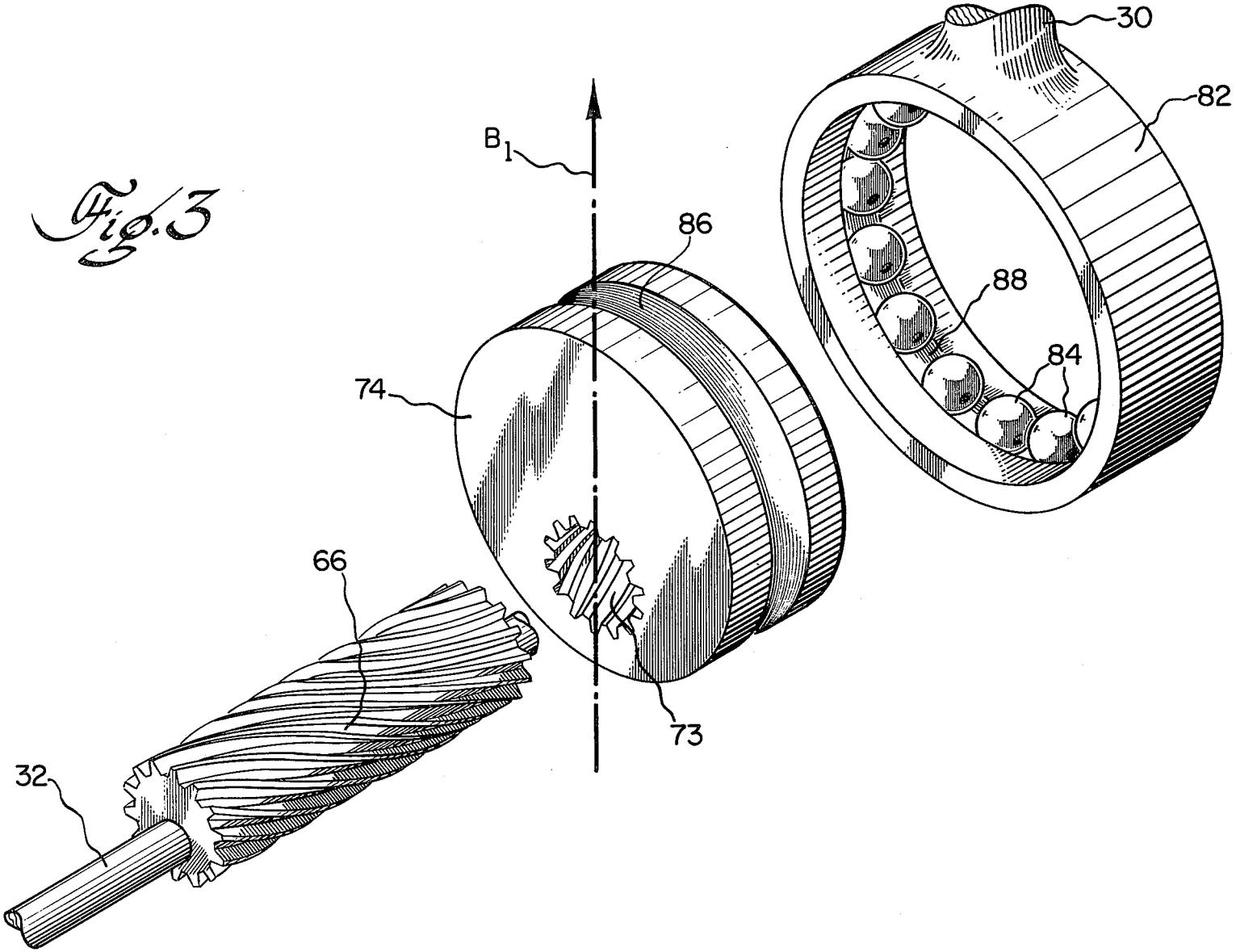
FIG. 3 is an exploded perspective view of the eccentric pair for piston No. 1 in FIG. 2.

Each of the cylindrical bodies 66, 68, 70 and 72 is mounted within a second cylindrical body 74, 76, 78 and 80, respectively. As best seen in FIG. 3, each of the second cylindrical bodies has a cylindrical bore 73 therethrough, extending parallel and eccentric to the axis of the second body. A set of internal helical threads or splines is formed in the bores 73 which match the external helical threads or splines on the first cylindrical body 66 so that the two bodies are threadedly engaged.

Each of the series eccentric pairs 66 and 74, 68 and 76, etc. has identical structure, and differs only in their angular orientation. Therefore, the remaining description of their structure will be directed at the eccentric pair 66/74 for piston No. 1, shown in FIG. 3. The second or outer cylindrical body 74 is mounted within a cylindrical ring or strap 82 to which the connecting rod 30 is attached. The second cylindrical body 74 rotates within the cylindrical strap 82 on a set of ball bearings 84 travelling in an inner bearing race 86 formed in the external cylindrical surface of the cylindrical body 74, and in outer bearing race 88 formed in the inner cylindrical surface of the strap 82.

The relative angular position of the first or inner eccentric body 66 with respect to the second or outer eccentric body 74 is adjusted by an axial shift of the inner body 66 relative to the outer body 74 so that the helical threaded engagement of the two bodies causes relative angular rotation of the two bodies. This relative axial translation of the inner body 66 could be achieved by a set of axial thrust bearings on the inner bodies and a mechanism which slides them along an axial spline connection on the shaft. Alternatively, (and as shown in FIG. 2) the inner body is rigidly attached to the shaft and axial translation is achieved by moving the entire shaft axially by an axial translation mechanism 90 which includes a thrust bearing 92 having thrust bearing surfaces on both sides of a thrust plate fixed to the end of the shafts 32 and 34. The thrust bearing 92 is slidably mounted in the crankcase 18 of the engine on guides 94 for movement parallel to the direction of the axis of the shaft 32. A worm gear or screw 96 driven by a reversible hydraulic or electric motor 98 is threaded into an axial bore in a boss 100 in the end of the thrust bearing 92 and controls its axial movement and the axial position of the shafts 32 and 34. The bearing 92 could be enlarged to receive both thrust runners, so that the position of both shafts 32 and 34 could be controlled by use of only a single motor 98.

The axial motion of the inner eccentric bodies produces a relative rotation of the inner and outer eccentric bodies with respect to each other by converting the axial motion to a rotation by virtue of the helical threads connecting the two cylindrical bodies. That is, the axial force exerted by the helical connection is resolved to a tangential force at the interface of the inner and outer eccentrics, which produces a relative rotation between them. In a similar manner, a torque exerted on one of the cylindrical bodies will cause an axial force to be exerted at the interface of the inner and outer cylindrical bodies. This axial force appears as an action in one direction and a reaction in the other direction. The axial forces exerted on the shafts 32 and 34 by the downward force of the piston rods acting through the outer eccentrics on the inner eccentrics tend to cancel out because of two series eccentric pairs on each shaft are both 180° apart at all times, irrespective of the stroke or phase adjustment of the engine. Therefore, the forces exerted by/on the piston rods of the pistons linked to one and the other driveshaft are always on opposite sides of the shaft, so the axial forces they exert on the shaft tend to cancel. To the extend that they are unequal, the unbalanced axial force is borne by the thrust bearing 92 and the reaction axial force which is exerted on the second or outer eccentric 74 is borne by a laterally orbitable thrust bearing assembly 102, shown only on the series eccentric pair 70/78 for piston No. 4 for clarity, but actually positioned adjacent each of the second cylindrical bodies 74, 76, 78 and 80. The thrust bearing assembly 102 includes two thrust bearing plates 104 which are axially supported by guide blocks 106 fixed in the crankcase on both sides of the shaft 34. The thrust bearing plates 104 orbit in slots 108 in the guide block 106 as the eccentric 70 rotates with the shaft 34. This ensures that the maximum axial thrust bearing surface of the thrust bearing plates 104 will engage the axially facing surface of the outer cylindrical body 78. The axial force exerted on the thrust bearing plates 104 is borne by the walls of the slots 108 in the supported blocks 106 in which the thrust bearing plates 104 are mounted.

In operation, assume the mechanism is set at maximum stroke and 90° phase position as shown in FIG. 2. To reduce the power of the engine, a control signal is sent to the motor 98 which rotates the screw 96 to cause axial translation of the shafts 32 and 34 to the right as shown by the arrows 110. The clockwise helical threads on the cylindrical bodies 66 and 68 will cause the second or outer eccentric bodies 74 and 76 to rotate counterclockwise with respect to the inner eccentric bodies 66 and 68, respectively. Likewise, the shaft 34 is moved axially to the right in FIG. 2 as shown by the arrow 111 and the counterclockwise helical spline or threads on the cylindrical bodies 70 and 72 cause the second eccentric bodies 78 and 80 to rotate clockwise relative to the inner cylindrical bodies 70 and 72. Thus it is seen that equal movement of the two shafts 32 and 34 in the same direction causes an equal and opposite relative rotation of the second cylindrical eccentric bodies on the two shafts. The rotation of the two outer bodies on one shaft is equal and in the same direction so that the inner cylindrical bodies on one shaft are always a 180° apart, and the outer cylindrical bodies on one shaft are likewise always 180° apart.

The thermodynamic connection between the pistons and their cylinders is shown by the arrows 1-2, 2-3, 3-4 and 4-1. That is, the expansion space of cylinder No. 1 is connected through a series connected heater, regenerator, and cooler (not shown) to the compression space of cylinder No. 2. The expansion space of cylinder No. 2 is connected through a heater, a cooler, and a regenerator to the compression space of cylinder No. 3. The expansion space of cylinder No. 3 is connected through a heater, a regenerator, and a cooler to compression space of cylinder No. 4; the expansion space of cylinder No. 4 is connected through a heater, a regenerator, and a cooler to the compression space of cylinder No. 1. In this way, a change in the phase relationship between the two shafts 32 and 34 causes a corresponding change between all of the thermodynamically coupled pistons because all thermodynamic connections are between pistons connected to different shafts rather than between pistons connected to the same shaft.

Figures 4A, 4B, 4C, 4D, 4E:
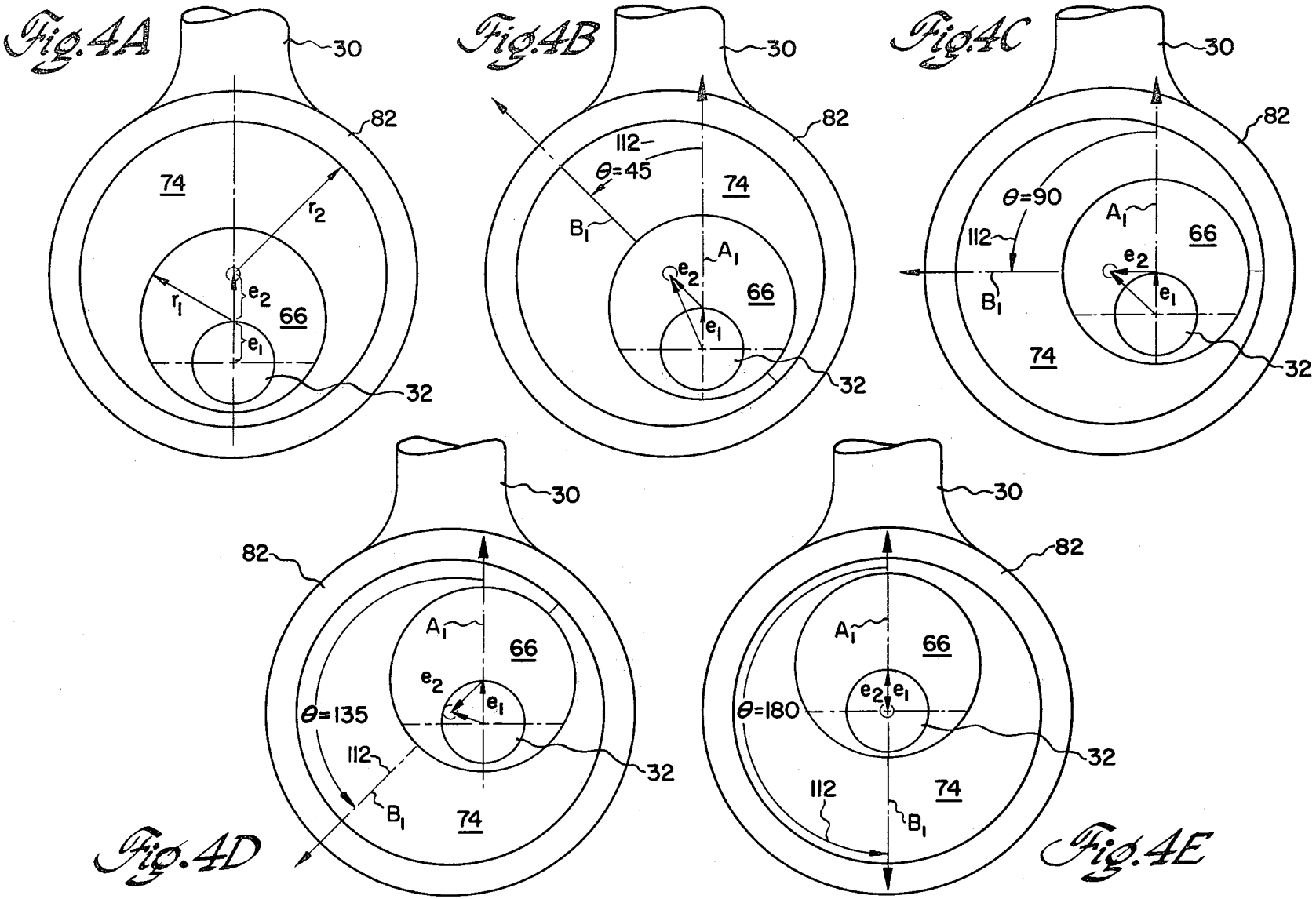
FIGS. 4A–4E are schematic elevations of the pair of series eccentrics for one piston showing the change in effective eccentricity with change in relative angular orientation of the two eccentrics.

In addition to changing the phase of the pistons of one shaft relative to the pistons on the other shaft, the effect of the axial movement of the shafts 32 and 34 is to change the stroke of the pistons. The phase is changed because the outer eccentric 74 rotates with respect to the inner eccentric 66 and the cylindrical strap or ring 82 orbits with the rotating outer eccentric. It is the position of the orbiting strap or ring that determines the phase position of the piston. The stroke is changed because the axes of maximum eccentricity A and B of the inner and outer eccentrics, respectively, no longer line up as shown in FIGS. 1, 2 and 4A but, with a shift of a relative angular position of the eccentric cylindrical bodies, as shown in FIGS. 4B–4E the axes of maximum eccentricity A and B of the inner and outer eccentrics are now angularly displaced and so the total or effective eccentricity of the two eccentric bodies taken as a whole is no longer simply additive but is rather additive by vector addition. Thus, looking at shaft 32, an axial movement to the right causes the second or outer eccentrics 74 and 76 to rotate in the direction shown by the arrows 112 so that the wide radius portion of the outer eccentrics 74 and 76 no longer line up with the wide radius portion of the inner eccentrics 74 and 76. At the 180° rotation of the outer eccentric 74 relative to the inner eccentric 66 as shown in FIG. 4E, the wide radius portion of the outer eccentric 74 aligns with the small radius portion of the inner eccentric 66.

The eccentricity $e_1$ of the inner eccentric body 66 is equal to the distance between its axis of rotation, which coincides with the axis of the shaft, and the axis of the cylindrical body 66. The eccentricity $e_2$ of the second cylindrical body 74 is equal to the distance between its axis and its center of rotation, which is the axis of the inner eccentric body 66. The effective eccentricity $e_3$ of the series pair of eccentrics is given by the expression $$e_3 = \sqrt{e_1^2 + e_2^2 - 2e_1e_2\cos\theta}$$

where Θ is the angle of rotation of the outer eccentric 74 relative to the inner eccentric 66 represented by the arrow 112. When the axes A and B of maximum eccentricity are co-directional as in the positions illustrated in FIGS. 1 and 4A, their eccentricities are additive and the effective eccentricity is $e_1+e_2$. As the inner and outer eccentrics are rotated relatively, increasing the angle Θ between their axes of maximum eccentricity A and B from 0° to 180°, the effective eccentricity decreases from a maximum of $e_1+e_2$ at 0° to a minimum at the 180° position where the eccentricities are subtractive and the effective eccentricity is the absolute valve of $e_1-e_2$. When the eccentrics are designed as illustrated so that their eccentricities $e_1$ and $e_2$ are equal, then the effective eccentricity at the low stroke point is zero and the stroke of the connecting rod 30 is zero.

It is thus possible to vary the stroke of the pistons in a regular and uniform way such that the stroke of all the pistons change equally with equal axial movement of the shafts 32 and 34, and simultaneously the phase position of the pistons changes also. Specifically, a relative rotation of the outer eccentrics around the inner eccentrics of 90° causes a phase change of that piston by 90°. If the other pistons are simultaneously undergoing an equal and opposite phase change, the phase change between adjacent pistons is found by adding the absolute phase change of the pistons separately so that, in the case of the pistons No. 1 and No. 2, a 90° rotation of the outer eccentric 74 for piston No. 1 in the counterclockwise direction shifts the phase of piston No. 1 by minus 90° and the corresponding equal and opposite rotation of the outer eccentric 80 of piston No. 2 shifts the phase of piston No. 2 by plus 90° so that the effect is equivalent to a phase shift of 180°. This is the phase position for engine reversal or fully regenerative braking. At lesser degrees of phase shift, the stroke would be reduced a lesser amount and the total phase shift would be correspondingly reduced.

The phase shift between pistons No. 2 and No. 3 is also equal and opposite. Specifically, the absolute phase change of piston No. 2 is plus Θ° and the absolute change of piston No. 3 is minus Θ° and therefore the relative phase position between pistons No. 2 and No. 3 is minus 2Θ°, or closer together in phase by 2Θ°. An equal axial shift of the shafts 32 and 34 produces an equal stroke change on all pistons and an equal phase change between all pairs of pistons. Because of the unique characteristic curve of the Stirling engine, the power characteristic curve is such that the power falls off approximately equally on both sides of the 90° phase position of the piston so that the power delivered by all four pistons is approximately equal even though the phase change is equal and opposite on adjacent pistons.

To improve the flexibility of the system and enable the phase and stroke modulation to be controlled separately, an additional phase control mechanism 120, shown in FIG. 2, is provided which enables the phase between the piston to be adjusted independently of piston stroke, and enables the phase change contributed by the change in the relative rotational orientation of the two eccentrics to be offset or nulled by the phase change contributed by the independently operable phase change mechanism 120 as described below.

The phase change mechanism 120 includes a helical gear 122L connected to the shaft 32 by means such as a spline connection 123 which permits the helical gear 122L to move axially relative to the shaft 32 and to transmit torque between the shaft 32 and the gear 122L. An identical helical gear 122R is likewise connected to the shaft 34 for axial sliding movement therealong and torque transmission therewith. The axial movements of the gears 122 along their shafts are controlled by a hydraulic translation mechanism 124 like the hydraulic gear translation mechanism shown in FIG. 7 of the forementioned Patent Application Serial No. 242,453. The control movement to cause a change in the phase relationship of the pistons connected to shafts 32 and 34 is an axial movement of the gears 122 along their shafts in opposite directions. Since the phase change created thereby is additive, the result in phase change will be twice the angular movement of the two shafts. Thus, if a certain axial movement of gears 122 produces a $\alpha°$ rotation of the gear 122L relative to the central helical gear 126 connected to the output shaft 25, and an equal and opposite rotation of $\alpha°$ of the gear 122R relative to the gear 124, then the relative phase change between the thermodynamically connected pistons on opposite shafts will be $2\alpha°$.

The two control techniques, namely the piston stroke and phase control 20 produced by the adjustable angular position of the inner and outer eccentrics, and the phase control 120 produced by the adjustable axial position of the gears 122 on their shafts, provide the means for independently adjusting the stroke and the phase of the pistons in this engine. When it is desired to change the phase of the pistons without changing the stroke, the phase can be adjusted by controlled axial movement of the gears 122 to produce the desired phase change between the shafts 32 and 34 and their connected pistons. When it is desired to change the stroke of the pistons without change of phase, the axial position of the shafts 32 and 34 is adjusted to rotate the inner and outer eccentrics relatively to the angular position that gives the effective eccentricity of the eccentric pairs to produce the desired stroke. The rotation of the outer eccentric bodies relative to inner eccentric bodies will also produce a phase shift of the piston Nos. 1 and 3 in one direction and a phase shift of piston Nos. 4 and 2 in the opposite direction. This produces an effective phase shift between all of the pistons because of the thermodynamic connection of pistons only to pistons on the other shaft. This phase shift can be cancelled by appropriate movement of the phase shift control 120 to produce an equal and opposite phase shift so that no net phase shift occurs. The result is a pure change of piston stroke without change of phase. It is thus possible to independently control the stroke and phase of the pistons, and to achieve any desired combination of piston stroke and phase.

In an automotive Stirling engine, it may be desirable to have the control movements made automatically, depending on the desired functions of the engine. For example, during high speed cruising it is desirable to have the pistons set at exactly 90° phase position and the lowest stroke possible consistent with power demand for highest engine efficiency. When starting the engine, it would be desirable to have an initial 0°/180° phase position and full stroke, which is then adjusted to 90° phase position to initiate gas cycling without cranking the engine. For reverse engine direction at low speed, it would be desirable to have the phase positions reverse a full 180° to 270° so that the engine direction is in reverse, and the piston stroke determined by the power requirements in reverse direction. Regenerative engine braking can be produced by a full engine stroke at a reversed phase position of −90° or 270° so that the engine acts as a heat pump driver by the kinetic energy stored in the moving masses. Heat is pumped back into the thermal energy storage medium 52 where it is available for reconversion again into kinetic energy, thereby resulting in an overall vehicle efficiency well in excess of the engine thermal efficiency itself. Since there are so many possible intermediate combinations of phase and stroke control positions, it may be a more attractive control scheme in some applications such as automotive to provide a microprocessor to convert the engine functions desired by the operator to control signals to the two main control elements 90 and 120 in order to achieve the desired combination of control movements.

Figure 5:
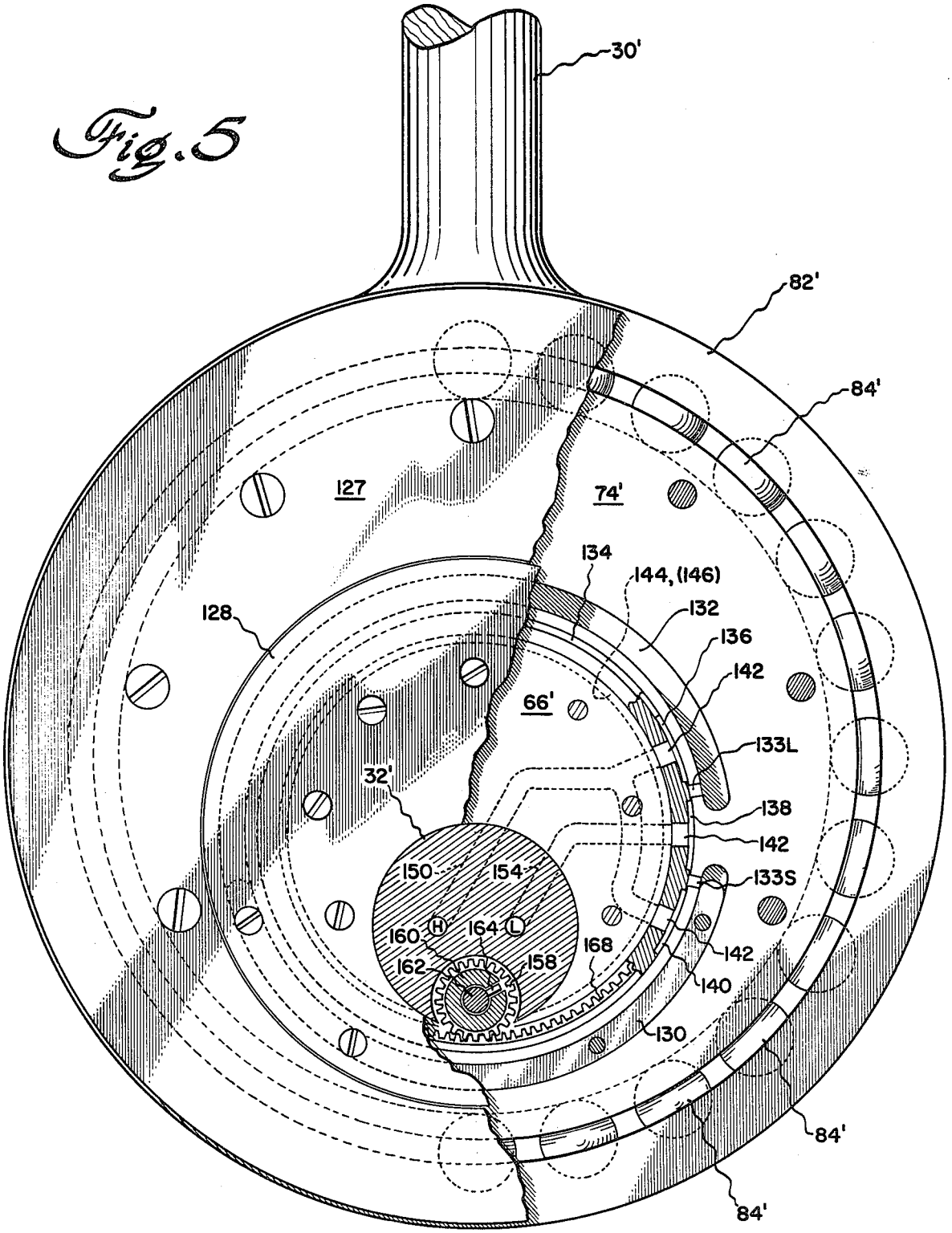
FIG. 5 is a sectional elevation of the eccentric connection between the connecting rod and the driveshaft showing an alternative control arrangement.
Figure 6:
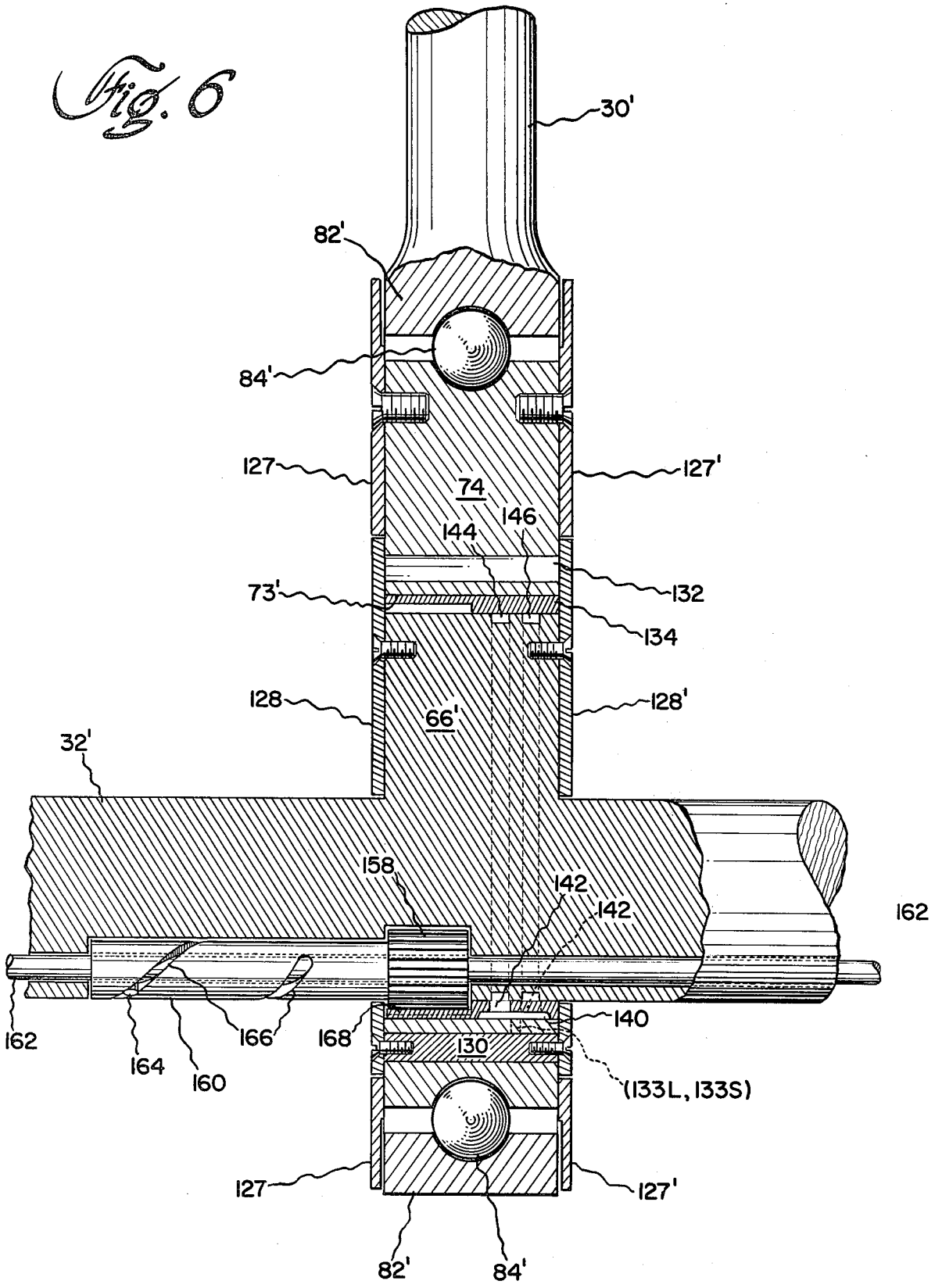
FIG. 6 is a sectional elevation along lines 6—6 in FIG. 5.
Figure 7:
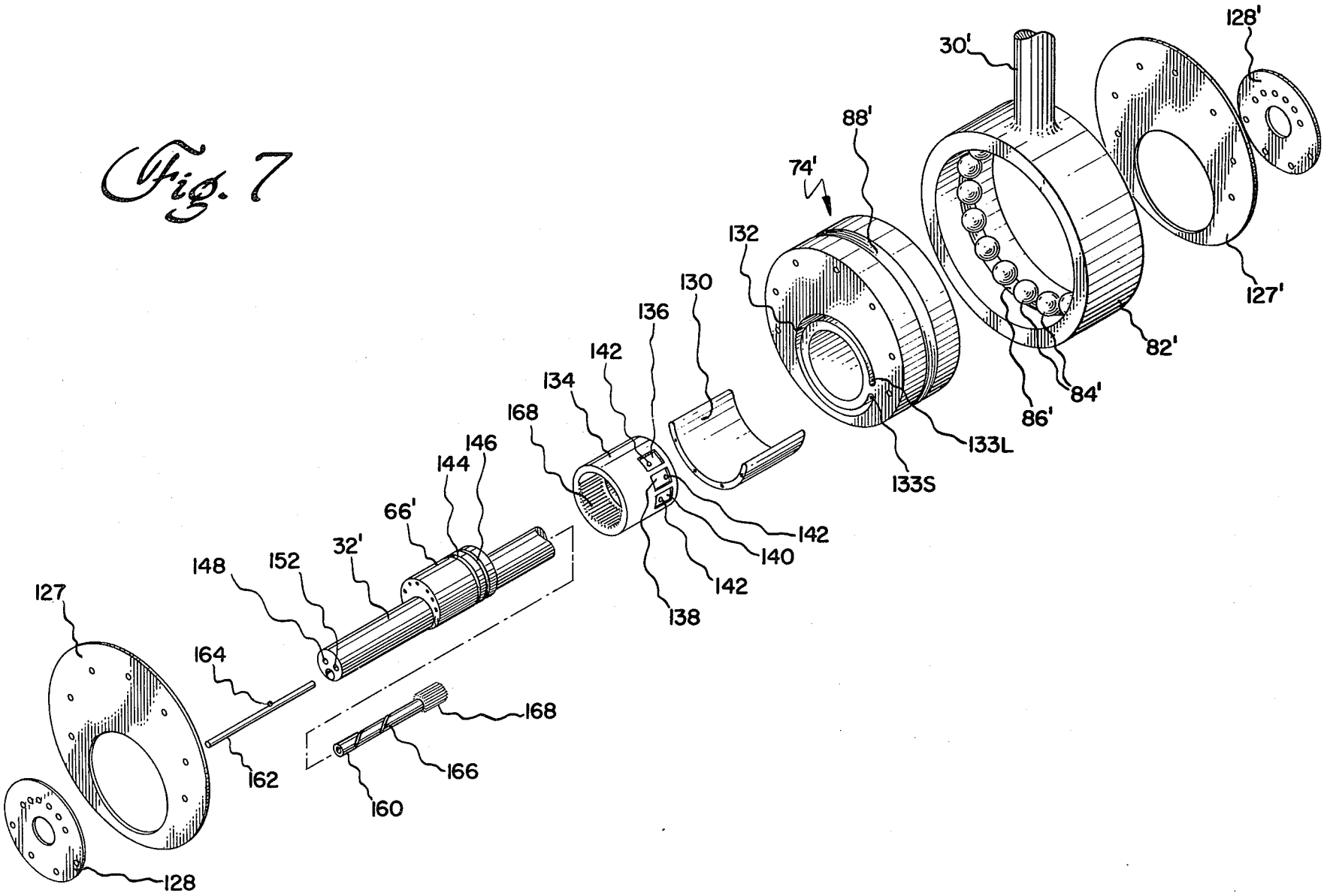
FIG. 7 is an exploded perspective view of the device shown in FIGS. 5 and 6.

Turning now to FIGs. 5–7, an alternate mechanism for adjusting the relative angular position of the inner and outer eccentrics enables the effective eccentricity of the pair of eccentric bodies to be changed so that the stroke of the connecting rod 30' and its piston is controlled thereby. The connecting rod 30' is connected to a cylindrical ring or strap 82' which surrounds the outer or second cylindrical eccentric 74' having a smooth bore 73' whose axis is eccentric to the axis of the cylindrical body 74'. The inner cylindrical eccentric body 66' is keyed or otherwise fixed to a shaft 32' such that the axis of the cylindrical body 66' is offset from the axis of the shaft 32'. An outer cover plate 127 is screwed to both sides of the outer eccentric 74' to hold it in place on the strap 82'.

The angular adjustment control device includes an arcuate piston 130 attached to an inner cover plate 128 which in turn is fastened to an axially facing surface of the inner eccentric body 66'. The arcuate piston 130 is coaxial with the bore 73' in the outer eccentric body 74' and extends into an arcuate recess 132 formed in the face of the outer eccentric body 74' coaxial with the bore 73'. Two ports 133L and 133S communicate between the recess 132, one at each end thereof, and the bore 73'.

An annular shuttle valve ring 134 is rotatably mounted between the cylindrical surface of the inner eccentric body 66' and the bore 73' of the outer eccentric body 74'. The valve ring 134 has three shallow recesses 136, 138, and 140 spaced circumferentially apart in its outside cylindrical surface. Three holes 142 extend radially through the valve ring 134, one each communicating between the floor of each recess and the interior surface of the ring 134. Two parallel annular grooves 144 and 146 are formed in the outer cylindrical surface of the eccentric 66'. One of the grooves 144 communicates with a high pressure oil passage 148 in the shaft 32' through a radial line 150, and the other groove 146 communicates with a low pressure oil passage 152 in the shaft 32' through a radial line 154. The source for the high and low oil pressure are the outlet and suction lines, respectively, of an oil pump, not shown.

The annular valve ring 134 is rotatably mounted in its position between the inner and outer eccentrics 66' and 74'. The position of the valve ring determines the relative angular position of the eccentric bodies 66' and 74', in a manner to be explained below. The position of the valve ring 134 is set by a control gear 158 mounted on one end of a control tube 160. The gear and tube are mounted in a cylindrical chamber in the shaft 32' and receive a control shaft 162 having a pin 164 that engages a helical groove 166 in the control tube. This enables an axial movement of the control shaft 162 to be resolved into rotational motion of the control tube 160 and attached control gear 158.

The control gear 158 is engaged with an internally geared sector rack 168 on the inside surface of the shuttle valve ring 134. Rotation of the control gear 158 rotates the ring valve 134. A counterclockwise rotation of the ring valve 134 in FIG. 5 will shift the position of the high pressure recess 140 into alignment with the port 133S and pressurize the portion of the arcuate recess 132 on the counterclockwise side of the arcuate piston 130, and also shift the position of the low pressure or drain recess 138 into alignment with the port 133L to drain the portion of the arcuate recess 132 on the clockwise side of the arcuate piston 130. This causes the piston 130 to rotate clockwise in or relative to the recess 132. Since the arcuate piston 130 is attached to the inner eccentric body 66' through the inner cover plate 128, rotation of the piston causes relative rotation of the inner and outer eccentrics 66' and 74' until the spaces between the end recesses 136 and 140 and the center recess 138 realigns with the ports 133L and 133S. Thus, an incremental counterclockwise motion of the ring valve 134 causes an equal and opposite motion of the inner eccentric 66', or an equal rotation of the outer eccentric 74' in the same direction as the ring valve 134. Thus, the rotation of the ring valve 134 produces an equal following rotation of the outer eccentric body 74' so that there is a unique relative angular orientation of the two eccentric bodies for each axial position of the control rod 162.

The hydraulic stroke control scheme shown in FIGS. 5–7 may be used in place of the mechanical stroke control shown in FIGS. 2 & 3. In both cases the phase control mechanism 120 may be replaced with the alternate phase control mechanism shown in my aforementioned copending application 242,453. By arranging the direction of the helical groove 166 in the control tube 160, it is possible to cause an equal movement of the control rods 162 and its corresponding mate in the other driveshaft (not shown) to cause an equal relative rotation of the eccentric bodies in the same direction so that no phase shift is produced thereby and the only effect is a change in the effective eccentricity of the series pair of eccentric bodies 66' and 74', and the other eccentric pairs of eccentric bodies for the other three pistons (not shown).

The engine of this invention provides a high degree of control flexibility and fully utilizes the regenerative potential of the Stirling engine. It enables the engine to be run in reverse, thereby eliminating the reverse gear in the transmission and provides a smooth power transition by smooth and continuous changes of phase and stroke. Indeed, by properly sizing the engine, it is possible to eliminate the transmission altogether. The phase and stroke change makes the latent thermal energy storage system suitable for vehicle application because of the regenerative braking uses in a double-acting Stirling engine. The thermal energy storage could be used in a vehicle as an energy storage system in competition with battery vehicles, or in hydrid vehicle applications. As such, the cold-start penalty of conventional Stirling engines is eliminated because the thermal energy storage canister is well insulated and stays hot for days, and the conduction losses from the heater head are minimized because of the thermal insulation between the heater head and the heat storage canister. The heater head in operation is held at a uniform temperature and is not subjected to the thermally induced stresses that a conventional combustor heated heater head experiences.

Obviously, numerous modifications and variations of the disclosed embodiments will occur to those skilled in the art.

It is therefore expressly to be understood that these modifications and variations, and the equivalents thereof, may be practiced while remaining within the spirit and scope of the invention, as defined in the following claims, wherein I claim:

1. A stroke control apparatus for a Stirling engine having a plurality of pistons coupled to a driveshaft, comprising:

a plurality of rings, one each operatively connected to each of said pistons and axially movable therewith and laterally movable with respect thereto;

a series eccentric mechanism for each of said pistons, including a first cylindrical eccentric body mounted eccentrically on said driveshaft with an eccentricity of $e_1$ and rotatable therewith; and a second cylindrical eccentric body mounted eccentrically on said first eccentric body within said ring with an eccentricity of $e_2$ and rotatable with respect to said ring and said first eccentric body;

means for changing the relative angular position of said first and second eccentric bodies;

whereby the degree of eccentricity contributed by said first and second eccentrics can be selectively added and subtracted to yield selected piston stroke valves between $e_1+e_2$ and the absolute value of $e_1-e_2$.

2. The apparatus defined in claim 1, wherein said angular position changing means includes a helical connection between said first and second eccentric bodies, and means for causing an axial translation between said first and second bodies, said axial translation being resolved by said helical connection into a relative angular translation of said eccentric bodies.

3. The apparatus defined in claim 1, wherein said angular position changing means includes a ported hydraulic chamber formed in one of said bodies, and a hydraulic piston attached to the other of said bodies and movably disposed in said hydraulic chamber.

4. The apparatus defined in claim 3, wherein said angular position changing means further comprises a follower valve mounted on said eccentric bodies and movable thereon to produce an incremental relative rotation of said bodies for an incremental movement of said valve.

5. The apparatus defined in claim 4, wherein said valve is a shuttle valve mounted between said bodies and coupled to said other body for sliding movement relative thereto under control of a valve control, such that movement of said shuttle valve opens said port to pressurize said hydraulic chamber and causes movement of said piston and said one member relative to to said ring valve to close said port and halt the pressurizing of said hydraulic chamber.

6. The apparatus defined in claim 5, wherein said valve position control includes a control gear mounted in said other body and a gear rack on said shuttle valve, said control gear engaging said gear rack and rotating with said other body; and means for rotating said control gear independently of the rotation of said other body.

7. The apparatus defined in claim 6, wherein said control gear rotation means includes a control shaft rotatable with said driveshaft and axially movable with respect thereto, and a helical connection between said control shaft and said control gear, whereby axial movement of said control shaft is resolved into rotational movement of said shuttle valve.

8. The apparatus defined in claim 1, wherein said engine is a double-acting Stirling engine; said angular position changing means rotates the eccentrics connected to thermodynamically connected pistons in opposite directions to change the phase between said thermodynamically connected pistons; and independently operable phase change means are coupled to said pistons to selectively alter the phase change introduced by said series eccentric mechanism.

9. The apparatus defined in claim 1, wherein said angular position changing means rotates the eccentrics connected to all of said pistons in the same direction, whereby the relative phase position of each of said pistons relative to each of the others remains unchanged while the stroke of said pistons change.

10. Apparatus for controlling the stroke of a piston of a Stirling engine, comprising:

an output shaft;

a ring operatively attached to said piston;

eccentric means including first and second eccentric bodies connected in series and torque transmitting relationship between said output shaft and said ring, said first and second eccentric bodies being rotatably mounted with respect to each other;

means for selectively maintaining and controllably shifting the angular position of said eccentric bodies relative to each other;

whereby the magnitude of said eccentric means relative to said shaft can be selectively adjusted to produce an eccentricity of said ring relative to said shaft anywhere between the sum and difference of the eccentricities of said first and second eccentric bodies.

11. The apparatus defined in claim 10, wherein:

said first and second eccentric bodies are connected together by helical threads; and said shifting means includes means for moving one of said eccentric bodies axially relative to the other eccentric body, such that the helical connection causes relative rotation between said eccentric bodies.

12. The apparatus defined in claim 10, wherein:

said first eccentric body includes a first cylindrical body coupled in torque transmitting relationship to said shaft, with the axis of said first cylindrical body parallel to and offset from the axis of said shaft by an eccentricity $e_1$;

said second eccentric body includes a second cylindrical body disposed between said first body and said ring, with the axis of said second body eccentric to the axis of said first body by an eccentricity $e_2$;

whereby orbiting movement of said ring drives said second body and said first body to rotate about the axis of said shaft and to drive said shaft to rotate.

13. The apparatus defined in claim 12, wherein the interface of said ring and said second body includes a bearing race and a set of rolling bearing elements disposed in said bearing race for low friction rotational support of said second body in said ring.

14. The apparatus defined in claim 12, wherein eccentricity $e_1$ is substantially equal to eccentricity $e_2$, so that said eccentric means can be adjusted to yield an effective eccentricity between about zero and about $2e_1$ for a piston stroke of between about zero and $2e_1$.

15. The apparatus defined in claim 12, wherein said shifting means includes means at the interface of said first and second bodies for exerting a tangential force on one body and an oppositely directed tangential reaction force on the other body to effect said relative angular motion of said first and second bodies.

16. The apparatus defined in claim 15, wherein said force exerting means includes a helical connection between said first and second bodies, and means for exerting an axial force on one of said bodies for effecting relative axial movement of said bodies, which axial movement is converted by said helical connection to relative rotational movement of said bodies.

17. The apparatus defined in claim 16, wherein said shaft and said first body are rigidly connected together; said shaft is mounted for axial movement relative to the crankcase of said engine; and said axial force exerting means includes a device for moving said shaft axially in said crankcase.

18. The apparatus defined in claim 16, wherein said first body is slidably mounted on said shaft for axial movement therealong, and said axial force exerting means includes a device for exerting a force on said first body for moving said first body along said shaft.

19. The apparatus defined in claim 15, wherein said engine includes four sets of said piston ring, and eccentric means, said rings being linked, two each, to two output shafts, each of said pistons on one shaft being thermodynamically connected to the two pistons on the other shaft; said rings being disposed at 180° positions apart on one shaft and at 180° positions apart on the other shaft; said shafts being arranged such that each ring on one shaft is normally disposed at positions 90° apart from both rings on the other shaft.

20. The apparatus defined in claim 19, wherein said force exerting means includes a helical connection between said first and second bodies and means for exerting an axial force on one of said bodies for effecting relative axial movement of said bodies, which axial movement is converted by said helical connection to relative rotational movement of said bodies; and said helical connections on one shaft have the same pitch and hand as each other, and said helical connections on the other shaft having the same pitch and hand as each other so that the axial reaction forces exerted by said bodies on said shafts tend to cancel out.

21. The apparatus defined in claim 19, further comprising:

coupling means for normally coupling said shafts together with a 1:1 ratio; and phase adjustment means for controllably shifting the phase position of said shafts relative to each other;

whereby the phase of said pistons relative to each other, and the stroke of said piston can be controlled independently.

22. An independently controllable phase and stroke control apparatus for the pistons of a double-acting Stirling engine, comprising:

N pistons driving at least two shafts, where N is an even integer greater than three, and each of said pistons is thermodynamically connected to two pistons on another shaft;

means associated with each piston for changing the stroke thereof and simultaneously for changing the phase relationship between said piston and the two pistons thermodynamically coupled thereto;

means for changing the relative phase positions of said shafts;

whereby the stroke of said pistons can be adjusted independently of the phase adjustment between the pistons by adjusting said stroke and phase means, and simultaneously adjusting said shaft phase changing means to introduce a phase change equal and opposite to the phase change that accompanies said stroke change to effectively cancel the phase change that accompanies the stroke change, and the phase position between thermodynamically connected pistons can be adjusted independently of stroke change by adjustment of said shaft phase change means.

23. The apparatus defined in claim 22, wherein said stroke and phase control includes a pair of eccentrics arranged in series and angularly adjustable with respect to each other so as to vary the effective eccentricity of the pair.

24. A stroke control apparatus for a reciprocating machine element in driving/driven relationship to a rotating shaft, comprising:

a first eccentric body fixedly mounted on the shaft for rotation therewith;

a second eccentric body rotatably mounted on said first eccentric body;

a hydraulic chamber in one of said eccentric bodies;

a hydraulically driven/driving member attached to the other of said bodies and movably disposed in said hydraulic chamber;

a valve element adjustably mounted on said other eccentric body for rotation therewith;

means for adjusting the position of said valve element on said other eccentric body; and a hydraulic circuit for supplying hydraulic fluid under pressure to said valve;

whereby said valve element can be adjusted from a sealing position to an active position to admit hydraulic fluid under pressure from a high pressure line to said hydraulic chamber, to pressurize said chamber and rotate said member in said chamber and rotate said other eccentric body relative to said one eccentric body, and simultaneously carry said valve element back into its sealing position to stop the relative movement between said eccentric bodies.

25. The apparatus defined in claim 24, wherein said valve element includes a plurality of passages, all of said passages sealing said chamber in said sealing position, and in said active position said passages admitting pressurized hydraulic fluid to one side of said chamber and simultaneously draining the other side of said chamber through a drain line.

26. The apparatus defined in claim 25, wherein said valve element is a cylindrical ferrule disposed at the interface between said eccentric bodies.

27. The apparatus defined in claim 26, wherein said hydraulic chamber is an arcuate slot formed in said one body concentric to said interface, and an orifice is formed at each end of said slot communicating between said slot and said interface.

28. The apparatus defined in claim 27, wherein said cylindrical ferrule includes three passages, one of which communicates in one active position between said orifice at one end of said slot and said high pressure line, and an other of which communicates in said one active position between said orifice at the other end of said slot and said drain line; and in said sealing position, said valve element seals both of said orifices.

29. The apparatus defined in claim 28, wherein, in another active position, said ferrule passages connect said one end of said slot with said drain line and connect said other end of said slot with said high pressure line to reverse the direction of relative rotation of said eccentric bodies.

30. The apparatus defined in claim 26, wherein said ferrule is internally gear-toothed, and further comprising a control gear mounted in said first eccentric body in engagement with the gear teeth on said ferrule, and means for rotating said control gear to cause adjustment of said eccentric bodies relative to each other.

* * * * *